US005926983A

United States Patent [19]

Tee et al.

[11] Patent Number: 5,926,983

[45] **Date of Patent: *Jul. 27, 1999**

[54] STEAM IRON WITH WATER BUFFER RESERVOIR

[75] Inventors: Song J. Tee; Robert A. Santhagens Van Eibergen, both of Singapore, Singapore

[73] Assignee: U.S. Philips Corporation, New York, N.Y.

[ * ] Notice: Under 35 U.S.C. 154(b), the term of this patent shall be extended for 02 days.

[21] Appl. No.: 08/984,823

[22] Filed: Dec. 4, 1997

[30] Foreign Application Priority Data

Dec. 12, 1996 [SG] Singapore ..... 9611672

[51] Int. Cl.[6] ..... D06F 75/18

[52] U.S. Cl. ..... 38/77.82

[58] Field of Search ..... 38/77.82, 77.83, 38/77.8, 77.7, 75, 96, 77.3, 77.2

[56] References Cited

U.S. PATENT DOCUMENTS

| | | | |
|---|---|---|---|
| 2,561,382 | 7/1951 | Kistner | 38/77.82 |
| 2,832,160 | 4/1958 | Beach | 38/77.82 |
| 2,878,600 | 3/1959 | Burmeister et al. | 38/77.82 |
| 3,224,122 | 12/1965 | Jepson et al. | 38/77.2 |
| 5,063,697 | 11/1991 | Valente et al. | 38/77.8 X |
| 5,307,573 | 5/1994 | Watkins | 38/77.82 |
| 5,404,662 | 4/1995 | Patrick et al. | 38/77.82 |

*Primary Examiner*—Ismael Izaguirre
*Attorney, Agent, or Firm*—Ernestine C. Bartlett

[57] ABSTRACT

The invention relates to a steam iron comprising a water reservoir having a front part which extends into the front of the iron. The water reservoir has an outlet opening situated in the front part of the reservoir, which opening opens into a metering space. The metering space opens into the steam chamber via an inlet opening. When the iron is placed into its rest position it is brought from a horizontal ironing position into an inclined position. To stop the steam production as rapidly as possible the iron comprises a water buffer reservoir situated in the heel of the iron, which buffer reservoir opens also into the metering space. When the iron is placed in an inclined position the water flows directly from the metering space into the buffer reservoir so that the water can no longer flow to the steam chamber. Advantage: no moving parts such as ball valves are required; steaming stops even in the case of a small inclination angle of 15°; a moderately inclined rest position is more convenient for the user.

8 Claims, 3 Drawing Sheets

STEAM IRON WITH WATER BUFFER RESERVOIR

BACKGROUND OF THE INVENTION

The invention relates to a steam iron comprising a housing, a soleplate, a steam chamber, heating means for heating the soleplate and the steam chamber, a water reservoir having a front part which extends up to a location in the front of the iron, which water reservoir has an outlet opening situated in the front part of the water reservoir, said outlet being connected to a metering space and said metering space opening into the steam chamber via a metering valve.

During ironing of a fabric a user frequently puts the steam iron away in a rest position. This is usually effected by upending the iron, so that it occupies a more or less vertical position. This short period after each ironing operation is used for rearranging the fabric to be ironed, after which the iron is picked up again and brought into a horizontal position for ironing. Cordless irons are known which, when no ironing takes place, are placed onto a stand in order to warm up. The irons are then placed on an inclined surface oriented at an angle of 40° to 50° to the horizontal. An inclined position is necessary to prevent water from the water reservoir from flowing into the steam chamber, as a result of which the iron would continue to produce steam while not in use. Generally, such an iron also comprises a ball valve, which shuts off the supply to the steam chamber when the iron is placed in an inclined position. These ball valves do not always function correctly and fairly often block the influx of water to the steam chamber during ironing.

SUMMARY OF THE INVENTION

It is an object of the invention to provide a steam iron which rapidly and reliably stops steaming when the user sets the iron in an inclined rest position.

To this end, the steam iron in accordance with the invention is characterized in that the iron has a water buffer reservoir disposed between the metering valve and the heel of the iron, which buffer reservoir has an outlet opening which is connected to the metering space, and that the water flows from the metering space into the buffer reservoir when the iron is placed in an inclined rest position, in which a plane in which the soleplate lies is disposed at an angle $\alpha$ of 15°–60° relative to the horizontal and the tip of the iron points upward.

The water reservoir and the buffer reservoir communicate with one another via the metering space, as a result of which the water level is the same in the water reservoir and in the buffer reservoir during ironing. Water can reach the steam chamber both from the water reservoir and from the buffer reservoir. As soon as the iron is placed in an inclined position, the water flows from the metering space into the buffer reservoir. At the same time, since the outlet opening of the water reservoir is situated in the front part of the reservoir, the water in the reservoir flows back into the rear part of the reservoir and can no longer reach the metering space. This is already achieved with an inclined position of the iron of 15°–60°, preferably 25°–45°. It is achieved that steaming stops rapidly and reliably in the rest position without the use of any movable parts, such as valves. An additional advantage is that from an ergonomical point of view it is more convenient for the user when the iron is put aside in a position which is only slightly inclined. This minimizes the load imposed on the arm and the pulse.

In a preferred embodiment the iron comprises two channel sections, one end of a first section is connected to the outlet opening of the water reservoir, one end of the second section is connected to the outlet opening of the buffer reservoir, and the other ends of both sections are connected to each other to form a mutual outlet which opens into the metering space.

If the water buffer reservoir is disposed in the heel of the iron an inclined rest position of the iron with an angle of 15° could be achieved.

In another preferred embodiment the buffer reservoir is located inside the water reservoir. This promotes the rapid outflow of the water from the metering space away from the metering valve into the buffer reservoir.

A further preferred embodiment of the iron in accordance with the invention is characterized in that in the outlet opening of the water reservoir a temperature-sensitive valve is located which opens when the temperature of the soleplate exceeds a preset value.

BRIEF DESCRIPTION OF THE DRAWINGS

The invention will now be described in more detail with reference to an exemplary embodiment shown in the drawings. In the drawings

DESCRIPTION OF THE PREFERRED EMBODIMENTS

Figure 1:
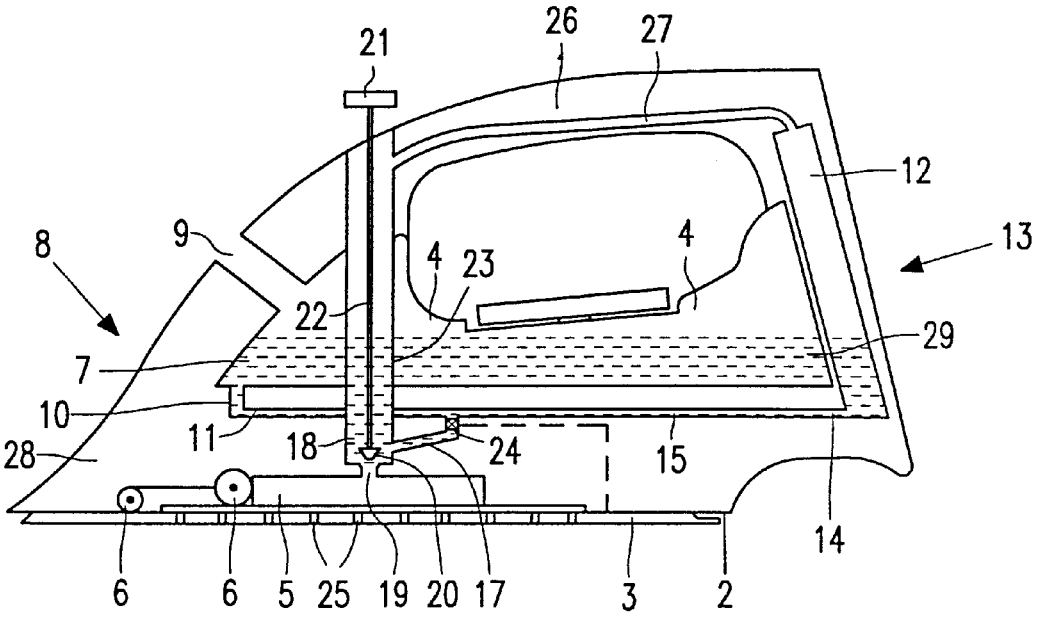
FIG. 1 shows a diagrammatical drawing of a steam iron in the ironing position.

The steam iron comprises a housing 1, which at its open underside 2 is closed by a soleplate 3. The housing accommodates a water reservoir 4, a steam chamber 5, and one or more heating elements 6 for heating the soleplate and the steam chamber. The front part 7 of the water reservoir 4 extends up to the front 8 of the iron. The water reservoir can be filled with water via a filling port 9 at the front of the iron. The water reservoir has an outlet opening 10 situated in the front of the water reservoir which outlet opening is connected to a channel section 11. A buffer reservoir 12 is situated in the heel 13 of the iron. The buffer reservoir has an outlet opening 14 which is connected to another channel section 15. This channel section 15 also buffers an amount of water. Both channel sections 11,15 are connected to each other at the location of the connection 16. From this connection a mutual channel 17 terminates into a metering space 18. At the bottom of the metering space there is an inlet opening 19 to the steam chamber 5. A metering valve 20 disposed in the inlet opening 19 of the steam chamber, is connected to a metering knob 21 by means of a metering rod 22 in order to control the size of the inlet opening and hence the amount of water flowing to the steam chamber. The metering rod 22 extends through a kind of hollow tube 23 to a location near the inlet opening 19 of the steam chamber. The lower part of the tube 23 is the metering space 18. The mutual channel 17 further includes a temperature-sensitive valve 24, which functions as what is referred to as a drip-stop. The temperature-sensitive valve does not open until the soleplate temperature has reached a given preset minimum value. This is in order to prevent water flowing to the steam chamber at too low a temperature, so that no or not enough steam is generated. The soleplate has steam outlet ports 25, which are connected to the steam chamber in known manner. The steam iron has a handle 26 which is disposed substantially horizontally in the ironing position (FIG. 1).

In the example shown in FIG. 1 the channel section 15 is disposed in line with the channel section 11, forming in fact one channel. The buffer reservoir 12 further has a vent 27. The volume of the buffer reservoir 12 is small in relation to that of the water reservoir 4. In the horizontal ironing positioning of the iron the water in the water reservoir and in the buffer reservoir has the same level because the two reservoirs, which are interconnected by means of the channel sections act as communicating vessels. During steam-ironing water is fed to the metering space 18 from both reservoirs 4 and 12.

Figure 2:
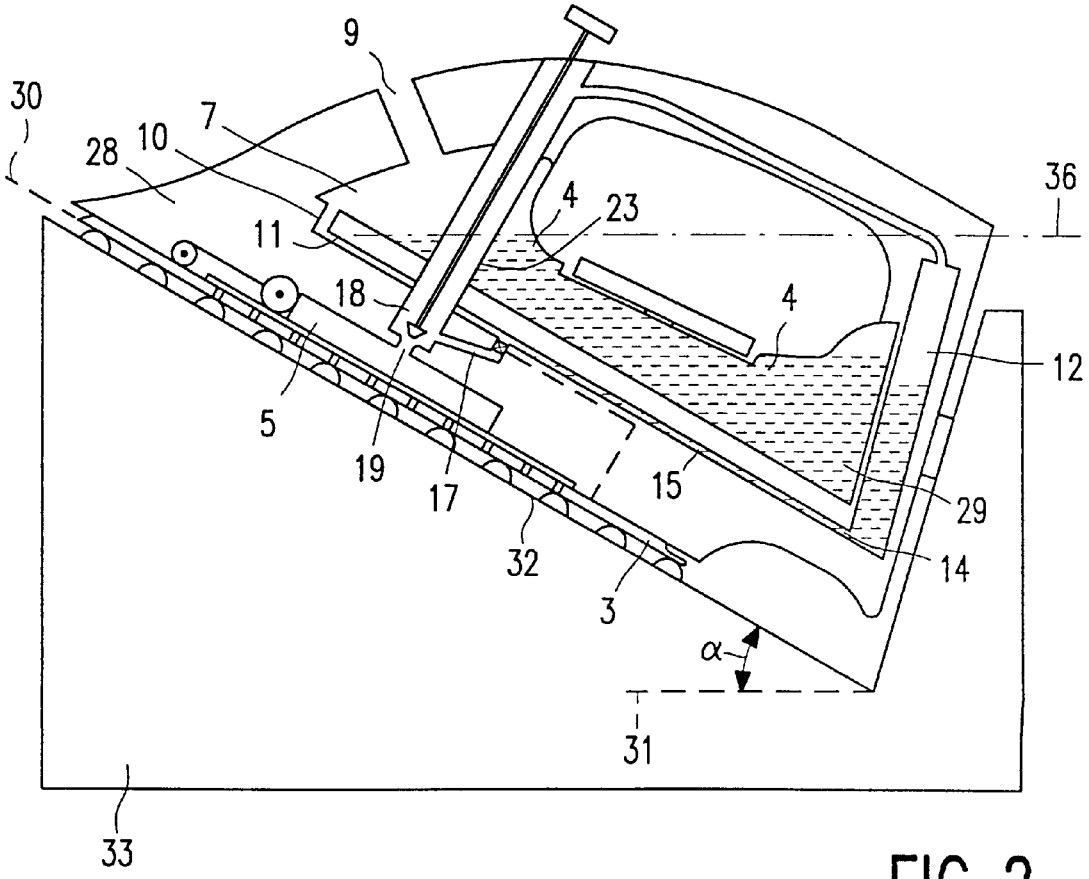
FIG. 2 shows a diagrammatical drawing of a steam iron in the inclined rest position on a stand.
Figure 3:
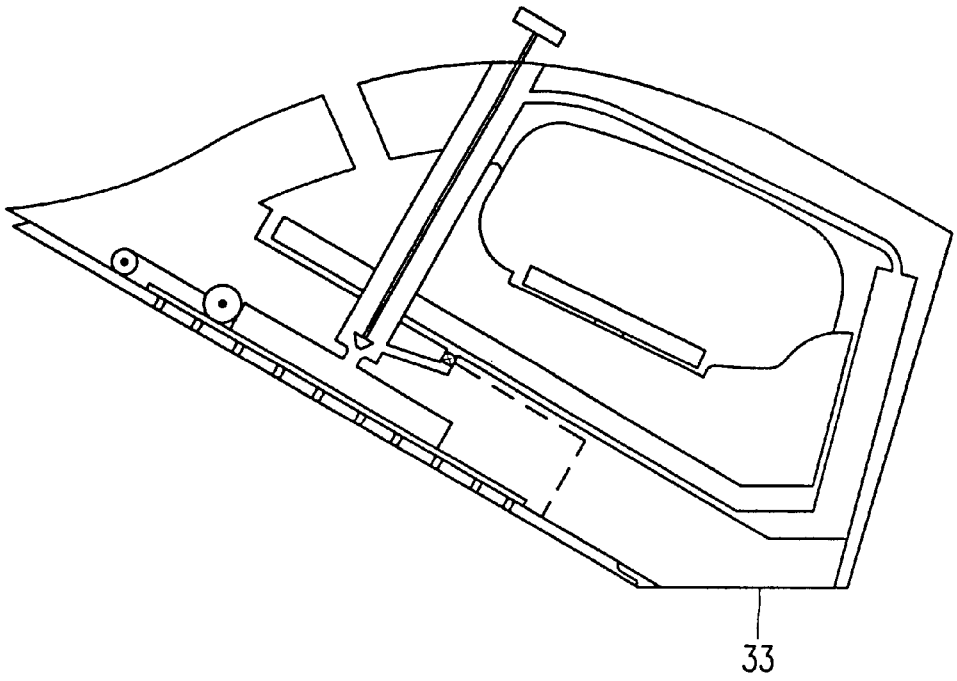
FIG. 3 shows a diagrammatical drawing of a steam iron in the inclined rest position on an inclined lower surface of the iron.

In the rest position of the iron it is disposed in an inclined position with the tip 28 of the iron pointing upwards, as shown in FIG. 2. As soon as the iron is in an inclined position the water in the front part 7 flows to the rear part 29 of the water reservoir 4. Moreover, the water in channel section 11 and the mutual channel 17 flows into the buffer reservoir 12 via the channel section 15. Thus, the water flows wholly away from the inlet opening 19, so that it can no longer reach the steam chamber. During ironing there will also be water in the metering space 18. This water gives rise to a given static water pressure at the inlet opening 19, which is favorable for a constant influx of water into the steam chamber. When the iron is put into its rest position this water will also flow back into the buffer reservoir 12. In fact, all the water flows away from the inlet opening of the steam chamber. In the inclined rest position of the iron the channel sections 11 and 15 as well as the mutual channel 17 should slope downward from the front 8 of the iron to the rear or heel 13 of the iron. This is already achieved when the soleplate 3, i.e. the plane 30 in which the soleplate lies, is disposed at an angle $\alpha$ of 15° relative to the horizontal 31. For putting the iron aside in the rest position (FIG. 2) a small angle is ergonomically most favorable for the user, whereas a larger angle would be better for stopping the steam production in the most rapid and reliable manner. It has been found that an angle between 15° and 60°, preferably between 25° and 45°, fulfills both requirements in a satisfactory manner. Placing the iron in the rest position can be effected by putting the iron on an inclined surface 32 of a stand 33. This can be, for example, the stand used in the case of cordless iron. However, alternatively, an inclined surface 33 (see FIG. 3), on which the iron rests in its rest position, may be provided at the underside of the iron at the rear. The location of the center of gravity of the iron, both in a condition with a fully filled reservoir and in a condition with an empty reservoir, should then be selected so as to obtain a stable rest position.

Figure 4:
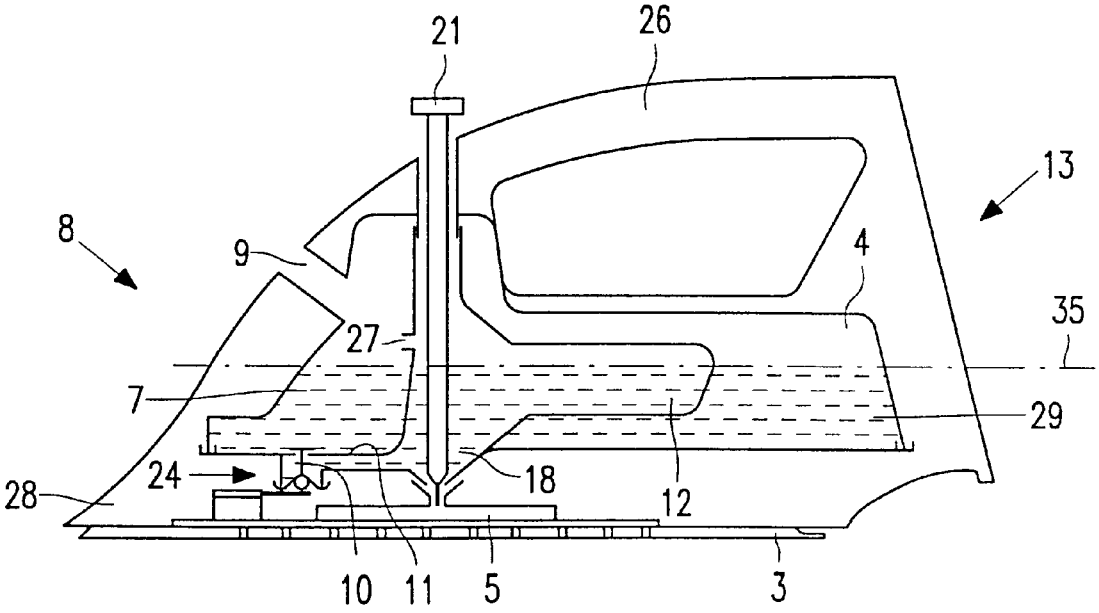
FIGS. 4–5 show an alternative embodiment of the steam iron according to the invention in which the buffer reservoir is located inside the main water reservoir.
Figure 5:
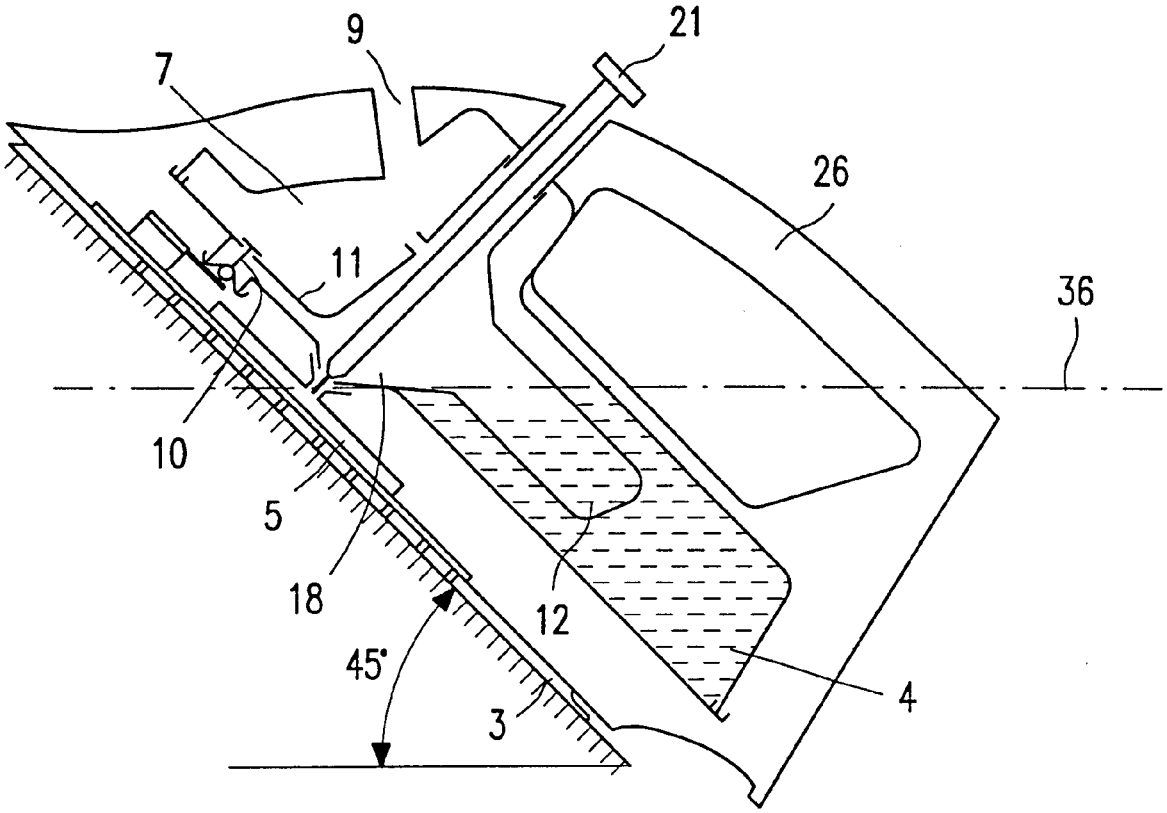

FIGS. 4 and 5 show a second embodiment of the invention. In this embodiment the same reference numerals as in the embodiment of FIGS. 1 and 2 are used. The buffer reservoir 12 is completely located inside the main water reservoir 4 and has a wide outlet opening 14 directly connected to the metering space 18. Due to this wide opening water flows rapidly away from the metering space into the buffer reservoir when the iron is placed in an inclined rest position. The maximal water level is indicated with reference numeral 35. The inclined position of the iron is also the water filling position.

We claim:

1. A steam iron comprising a housing, a soleplate, a steam chamber, heating means for heating the soleplate and the steam chamber, a water reservoir having a front part which extends up to a location in the front of the iron, which water reservoir has an outlet opening situated in the front part of the water reservoir, said outlet opening being connected to a metering space and said metering space opening into the steam chamber via a metering valve, wherein the iron has a water buffer reservoir disposed between the metering valve and the heel of the iron, which buffer reservoir has an outlet opening which is connected to the metering space, and the water flows from the metering space into the buffer reservoir when the iron is placed in an inclined rest position, in which a plane in which the soleplate lies is disposed at an angle $\alpha$ of 20 –60° relative to the horizontal and the tip of the iron points upward, steaming of the iron ceasing substantially when it is placed in said inclined rest position.

2. A steam iron as claimed in claim 1, wherein the buffer reservoir is located inside the water reservoir.

3. A steam iron as claimed in claim 1, wherein the buffer reservoir has a vent.

4. A steam iron comprising a housing, a soleplate, a steam chamber, heating means for heating the soleplate and the steam chamber, a water reservoir having a front part which extends up to a location in the front of the iron, which water reservoir has an outlet opening situated in the front part of the water reservoir, said outlet opening being connected to a metering space and said metering space opening into the steam chamber via a metering valve, wherein the iron has a water buffer reservoir disposed between the metering valve and the heel of the iron, which buffer reservoir has an outlet opening which is connected to the metering space, and the water flows from the metering space into the buffer reservoir when the iron is placed in an inclined rest position, in which a plane in which the soleplate lies is disposed at an angle $\alpha$ of 20°–60° relative to the horizontal and the tip of the iron points upward, and wherein the iron comprises two channel sections in which one end of a first section is connected to the outlet opening of the water reservoir, one end of the second section is connected to the outlet opening of the buffer reservoir, and the other ends of both sections are connected to each other to form a mutual outlet which opens into the metering space.

5. A steam iron as claimed in claim 4, wherein the buffer reservoir is disposed in the heel of the iron.

6. A steam iron as claimed in claim 4, wherein in the mutual outlet of the channel sections a temperature-sensitive valve is located which opens when the temperature of the soleplate exceeds a preset value.

7. A steam iron comprising a housing, a soleplate, a steam chamber, heating means for heating the soleplate and the steam chamber, a water reservoir having a front part which extends up to a location in the front of the iron, which water reservoir has an outlet opening situated in the front part of the water reservoir, a temperature-sensitive valve located in said outlet opening which opens when the temperature of the soleplate exceeds a preset value, said outlet opening being connected to a metering space and said metering space opening into the steam chamber via a metering valve, wherein the iron has a water buffer reservoir disposed between the metering valve and the heel of the iron, which buffer reservoir has an outlet opening which is connected to the metering space, and the water flows from the metering space into the buffer reservoir when the iron is placed in an inclined rest position, in which a plane in which the soleplate lies is disposed at an angle $\alpha$ of 20°–60° relative to the horizontal and the tip of the iron points upward.

8. A steam iron comprising a housing, a soleplate, a heel, a steam chamber, heating means for heating the soleplate and the steam chamber, a water reservoir having a front part which extends up to a location in the front of the iron, which water reservoir has an outlet opening situated in the front part of the water reservoir, said outlet opening being connected to a metering space and said metering space opening into the steam chamber via a metering valve, wherein the iron has a water buffer reservoir disposed in the heel of the iron, which buffer reservoir has an outlet opening which is connected to the metering space, and the water flows from the metering space into the buffer reservoir when the iron is placed in an inclined rest position, in which a plane in which the soleplate lies is disposed at an angle $\alpha$ of 15° relative to the horizontal and the tip of the iron points upward, steaming of the iron ceasing substantially when it is placed in said inclined rest position.

* * * * *